US009327943B2

(12) United States Patent
Lin

(10) Patent No.: US 9,327,943 B2
(45) Date of Patent: May 3, 2016

(54) STAIRWELL LIFT

(71) Applicant: Chen-Hsin Lin, New Taipei (TW)

(72) Inventor: Chen-Hsin Lin, New Taipei (TW)

( * ) Notice: Subject to any disclaimer, the term of this patent is extended or adjusted under 35 U.S.C. 154(b) by 0 days.

(21) Appl. No.: 14/541,384

(22) Filed: Nov. 14, 2014

(65) Prior Publication Data

US 2015/0175387 A1 Jun. 25, 2015

(30) Foreign Application Priority Data

Dec. 20, 2013 (TW) ..... 102224075 U

(51) Int. Cl.

| | |
|---|---|
| ***B66B 9/00*** | (2006.01) |
| ***B66B 9/08*** | (2006.01) |
| ***B66B 1/24*** | (2006.01) |
| ***B66B 11/02*** | (2006.01) |
| ***B66B 11/04*** | (2006.01) |

(52) U.S. Cl.

CPC ... *B66B 9/00* (2013.01); *B66B 1/24* (2013.01); *B66B 9/08* (2013.01); *B66B 9/0853* (2013.01); *B66B 11/0226* (2013.01); *B66B 11/04* (2013.01)

(58) Field of Classification Search

CPC ..... B66B 9/00; B66B 9/08; B66B 9/0853; B66B 1/24; B66B 11/0226; B66B 11/04

USPC ..... 187/200

See application file for complete search history.

(56) References Cited

U.S. PATENT DOCUMENTS 4,438,830 A * 3/1984 Born ..... B66B 9/083 187/201
4,457,402 A * 7/1984 Del Vecchio ..... A61G 3/06 105/449
5,050,708 A * 9/1991 Wood ..... B66B 9/0838 187/201
5,499,694 A * 3/1996 Dorn ..... A61G 5/1059 187/200
5,553,990 A * 9/1996 Kytola, Sr. ..... B66B 9/04 182/146
5,595,265 A * 1/1997 Lebrocquy ..... A01M 31/02 187/244
7,325,654 B2 * 2/2008 Stanislao ..... B66B 9/083 187/201
7,395,900 B2 * 7/2008 Murray ..... B66B 9/0869 187/200
7,509,701 B2 * 3/2009 Wirzberger ..... E01D 15/24 14/69.5
7,537,069 B2 * 5/2009 Kramer ..... A47C 7/62 180/21
8,146,713 B2 * 4/2012 Rosenthal ..... B66B 9/083 187/200
8,316,994 B1 * 11/2012 Rands ..... B66B 9/187 182/141
2002/0098077 A1 * 7/2002 Beech ..... B66B 9/08 187/201
2014/0231175 A1 * 8/2014 Mueller ..... B66B 9/0853 187/200

* cited by examiner

*Primary Examiner* — William A Rivera
*Assistant Examiner* — Michael Riegelman
(74) *Attorney, Agent, or Firm* — Rosenberg, Klein & Lee

(57) ABSTRACT

A stairwell lift installed in or nearby a stairwell connecting in between upstairs and downstairs includes at least two supporting columns, a passenger space, at least two sliding portions, and at least one driving mechanism. Each supporting column has a column top portion and a column bottom portion, wherein the two column bottom portions are oppositely disposed on a space in or nearby the stairwell. The passenger space is disposed between the two supporting columns. Each sliding portion is respectively fixed on a side of the passenger space and encased each supporting column. The driving mechanism is disposed above the top of two supporting columns for driving the passenger space along the supporting columns up to the upstairs or down to the downstairs.

7 Claims, 8 Drawing Sheets

STAIRWELL LIFT

FIELD OF THE INVENTION

The present invention is a lift, specially designed to be installed in a stairwell or nearby space.

BACKGROUND OF THE INVENTION

With the progress of medical science and technology, the life expectancy of the modern people is being increased year by year. Most of the major countries are becoming an ageing population society. For the elderly living in residences of designs having upper and lower floors, a stairway is necessary for them to do daily activities. This causes certain troubles to the elderly or the disabled people.

Various small-sized lifts are available at present for being installed inside a residence. Among these lifts, one is a household lift of which the installation requires a lift shaft. Another one is a stairway lift that comprises a rail that is arranged to follow the spiral of a stairway and is mounted to a wall of a stairway. The lift that requires a lift shaft often occupies an excessive amount of space and the installation may requires damages made on the building and the subsequent maintenance expenditure is high. The stairwell lift can be installed without concerns about constrained imposed by the limited space, but the stairway lift, when moving upwards along the rail, is readily susceptible to vibration and shaking and may thus cause concerns of safety. In addition, the stairway lift and the rail often need to occupy a major part of the space of the stairway, making it inconvenient to walk or to carry articles through the stairway.

Thus, the present invention aims to provide a lift that occupies a less amount of space and is safe and convenient in order to overcome the issue of moving between upper and lower floors in a residence.

SUMMARY OF THE INVENTION

The primary object of the present invention is to provide a stairwell lift, which is arranged in or nearby a stairwell to connect between the upstairs and the downstairs and comprises at least two supporting columns, a passenger space, at least two sliding portions, and a driving mechanism. Each supporting column has a column top portion and a column bottom portion and the two column bottom portions are fixed on a step of a stairwell or fixed to a space inside or nearby a stairwell to be opposite to each other. The passenger space is arranged between supporting columns. The sliding portions are respectively mounted to two sides of the passenger space and are respectively fit over the supporting columns. The driving mechanism is mounted above the top of two supporting columns to drive the passenger space to move along the supporting columns for ascending to the upstairs or descending to the downstairs.

The stairwell lift of the present invention is such that the passenger space is designed according to the configuration and dimensions of the stairway and the sliding portion that are mounted to the two sides of the passenger space are respectively fit over the supporting columns, so that the stairwell lift of the present invention not only has a wide and comfortable riding space and but also effectively protects the safety of the passenger.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1A:
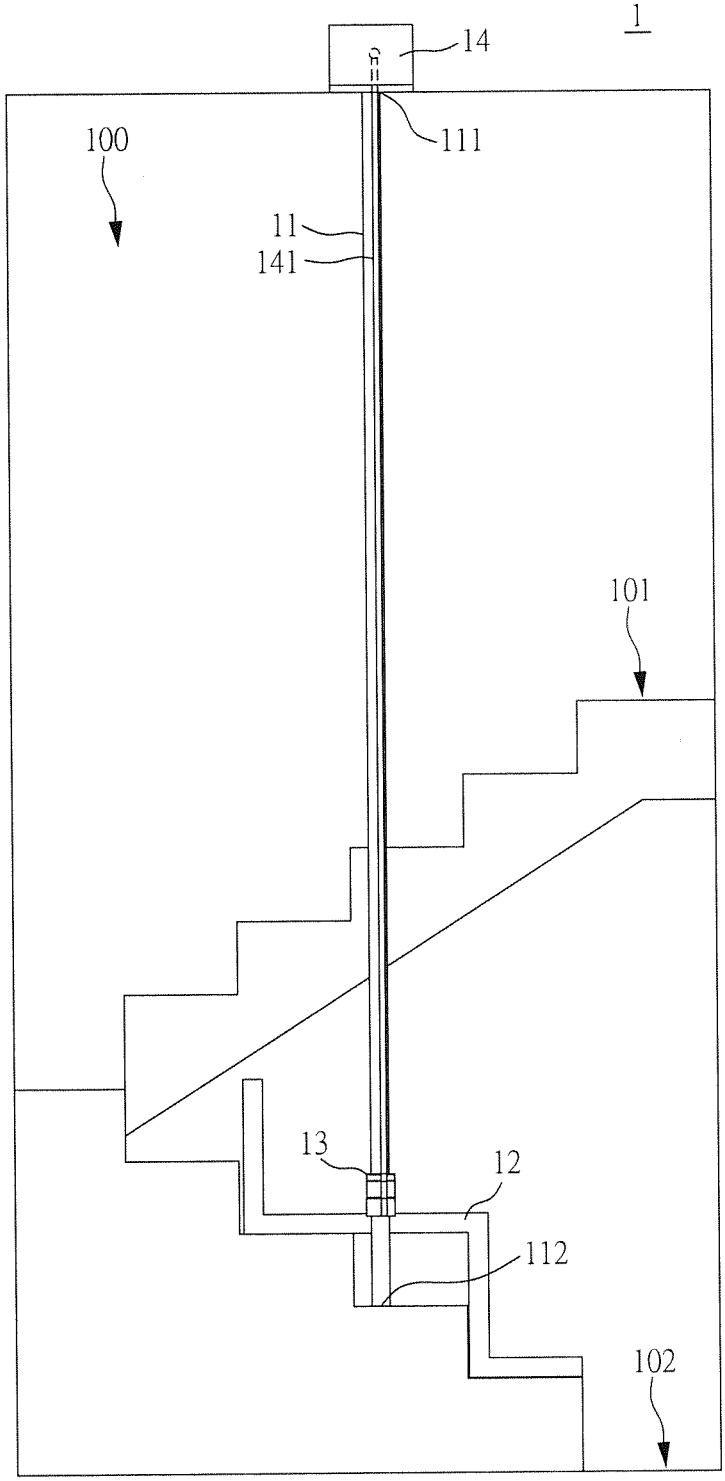
FIGS. 1A and 1B are schematic views illustrating an arrangement of a stairwell lift in accordance with the present invention.
Figure 1B:
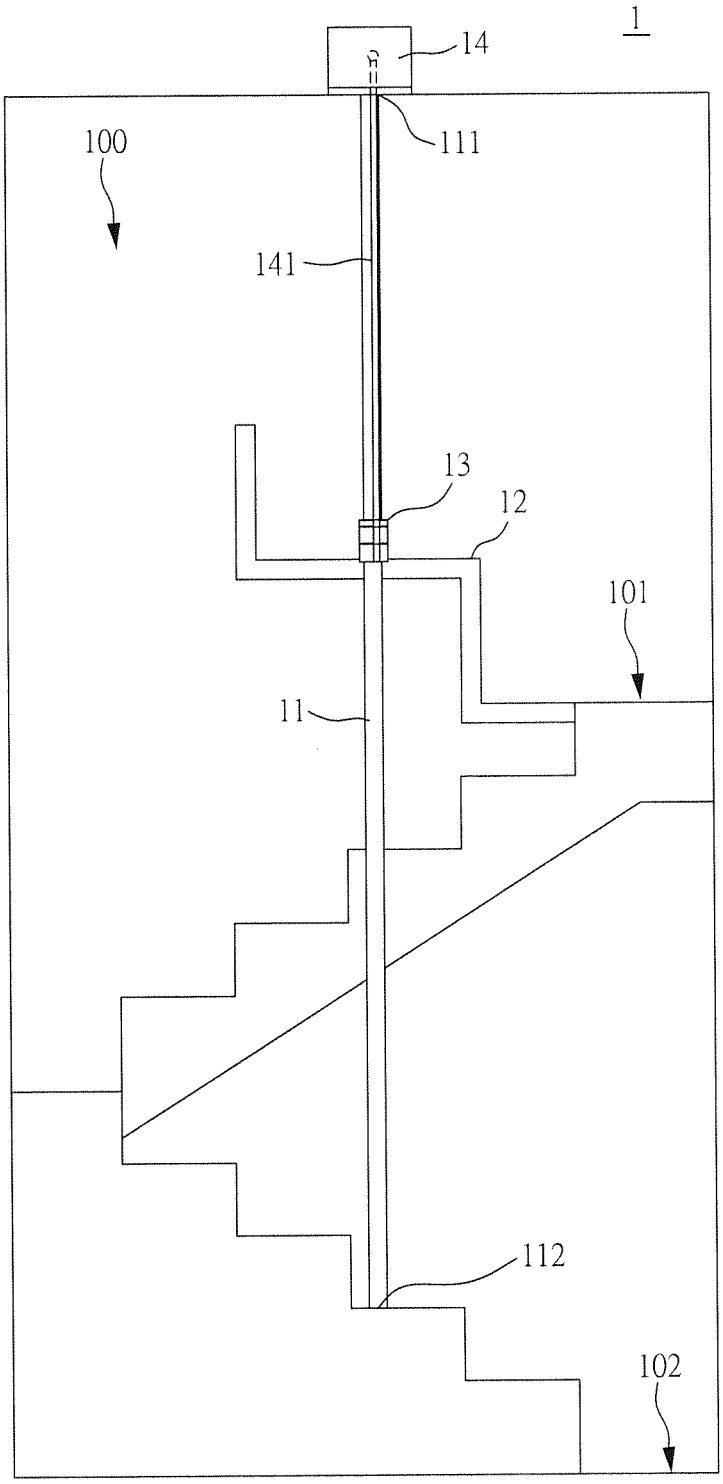
Figure 1C:
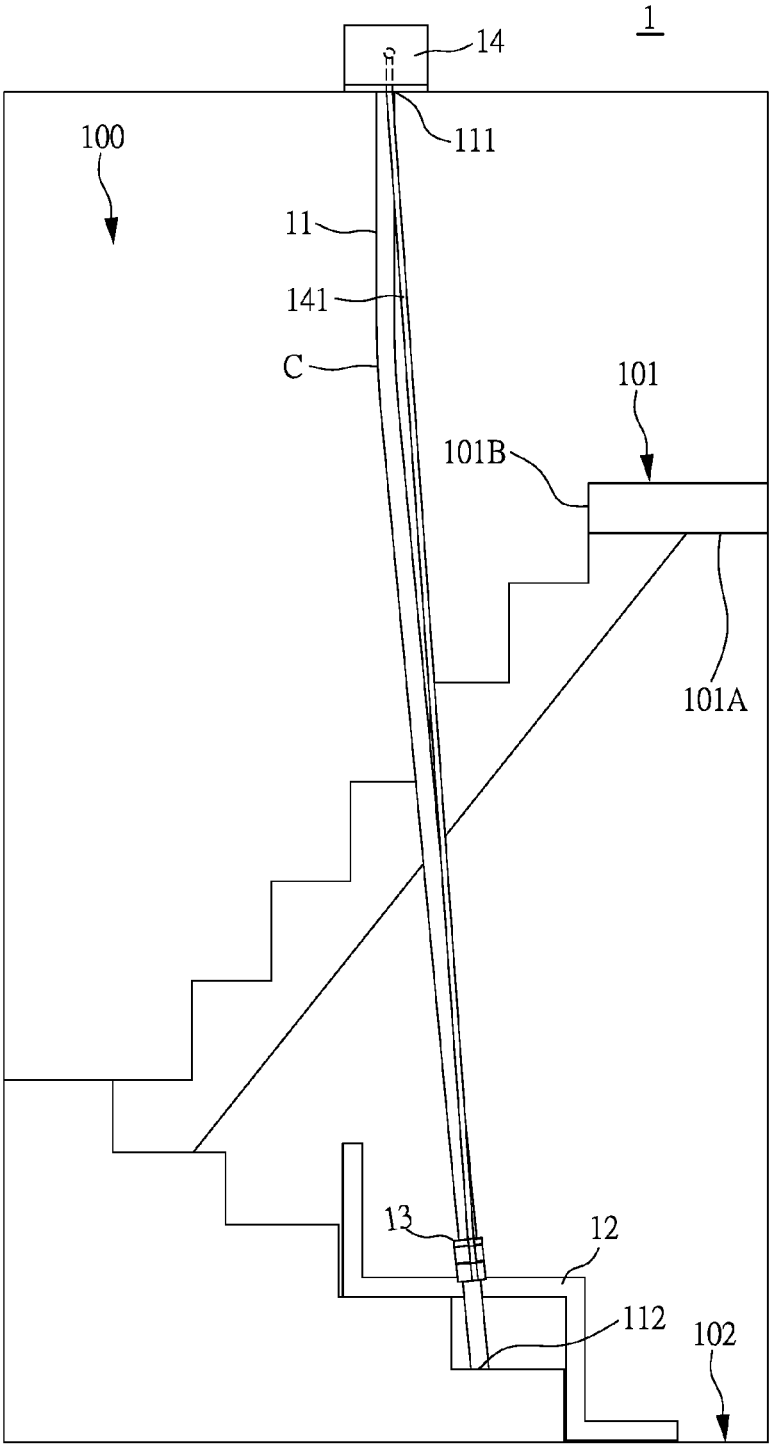
FIGS. 1C and 1D are schematic views illustrating an alternate arrangement of a stairwell lift in accordance with the present invention.
Figure 1D:
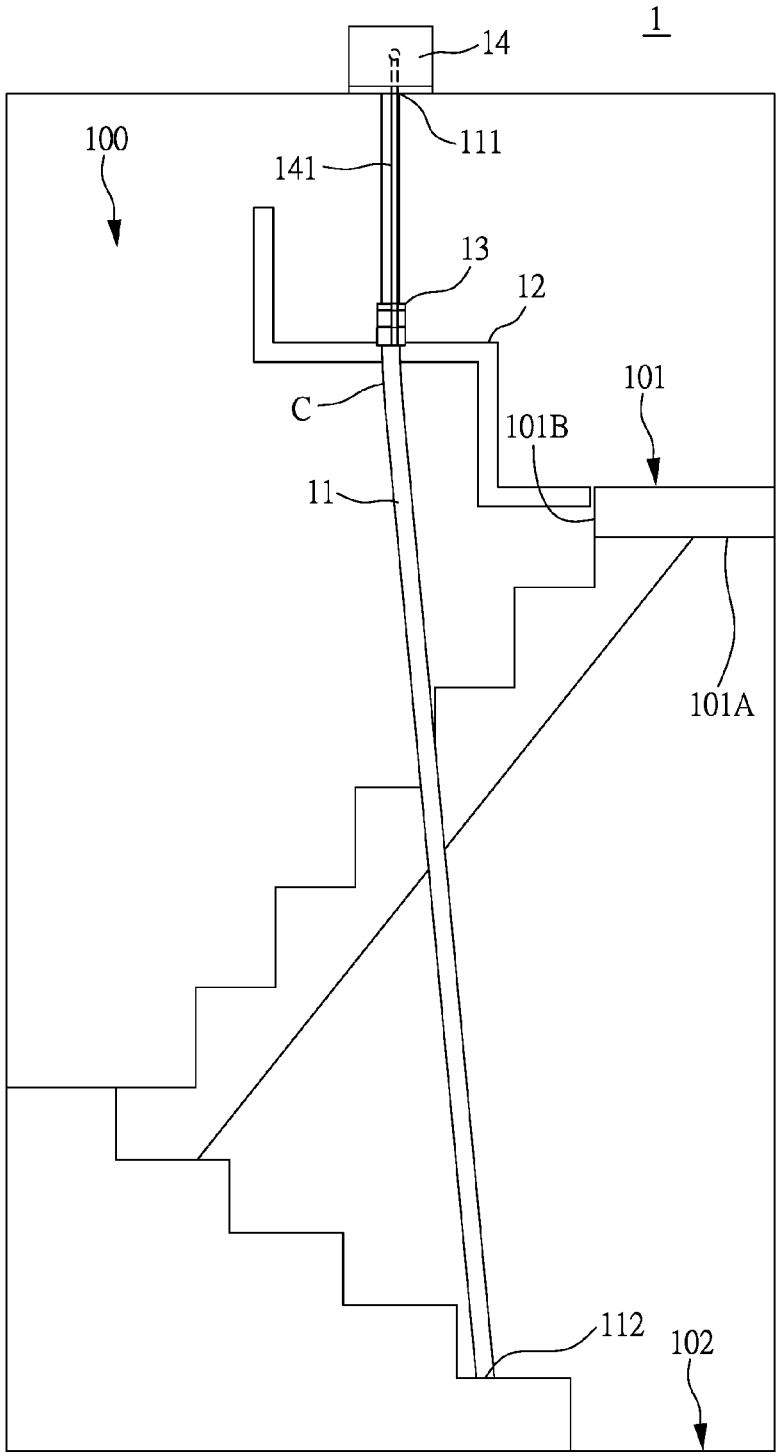

The present invention provides a stairwell lift, which is suitable for installation between passageways extending in between higher and lower floors space, wherein the passageways may include a stairway, a slope, or other passages. Further, the passageway can be a passage that is continuous, segmented, spiral, helical, vertical, or stepwise that is made according to floor designs and the stairwell lift of the present invention is arranged to have a moving path that matches the passageway design. FIGS. 1A and 1B illustrate an arrangement of the stairwell lift according to the present invention. Reference is now made to schematic views shown in FIGS. 1A and 1B, where the stairwell lift 1 is arranged in or nearby a stairwell 100 connecting between the upstairs 101 and the downstairs 102 and comprising at least two supporting columns 11, a passenger space 12, at least two sliding portions 13, and a driving mechanism 14. In the present invention, each supporting column 11 has a column top portion 111 and a column bottom portion 112 and the two column bottom portions 112 are fixed on a stair step of the stairwell 100 or nearby the stairwell 100 to be opposite to each other. The positions of the supporting columns 11 can be modified or adjusted, in an adaptive manner, according to the configuration of the stairwell 100. For example, the column bottom portions 112 of the supporting columns 11 can be selectively fixed on a horizontal surface of the same step or attached to opposite sidewalls respectively. The column top portions 111 of the supporting columns 11 can be fixed by bracings or wall pins (not shown) to a ceiling or sidewalls of the upstairs 101. In an embodiment of the present invention, the passenger space 12 is designed to match the configuration and size of the stairway (slope or other passages). A fixed location of the passenger space 12 on the downstairs 102 is resting on the first to third steps of the stairway and a fixed location of the passenger space 12 on the upstairs 101 is aligning with a floor surface adjacent to an upstairs entrance of the stairway. The sliding portions 13 are respectively mounted to two opposite sides of the passenger space 12 and are respectively fit over the supporting columns 11. The driving mechanism 14 is disposed above the top of two supporting columns 11 to drive the passenger space 12 to move along the two supporting columns 11 for ascending to the upstairs 111 or descending down to the downstairs 112. Further, FIGS. 1C and 1D are schematic views illustrating an alternate arrangement of a stairwell lift in accordance with the present invention, the supporting columns 11 may be arranged to partly curve according to the location of the ceiling 101A or sidewalls 101B of the upstairs 101 so as to allow the passenger space 12 to move up vertically after avoiding the ceiling 101A or sidewalls 101B of the upstairs 101 during an ascending travel.

The present invention provides a design of the passenger space 12 that allows a passenger to easily step in and out of the passenger carrier 12 for being moved, back and forth, between the upstairs 101 and the downstairs 102 to do daily activities. Further, the sliding portions 13 that are mounted to the two sides of the passenger space 12 are fit over the supporting columns 11 in such a way that when the driving mechanism 14 drives the passenger space 12 to ascend or descend along the supporting columns 11, the passenger space 12 is not readily subjected to severe vibration and shaking thereby greatly improving the safety of the stairwell lift 1. For easy illustration, in the subsequent drawings, only the stairwell lift is illustrated and the relative position of the stairwell lift in the stairwell is not demonstrated.

Figure 2:
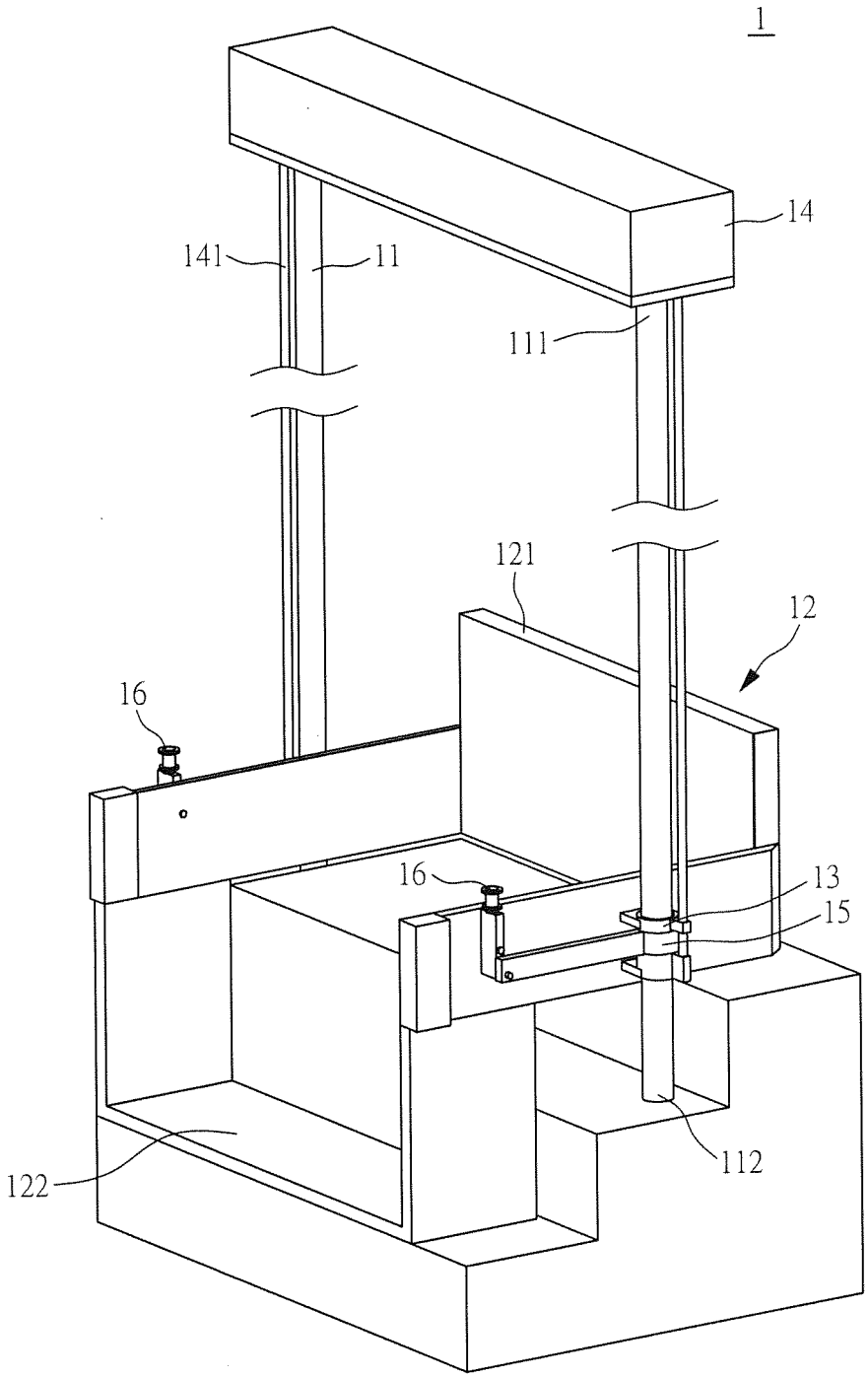
FIG. 2 is a perspective view illustrating a first embodiment in accordance with the present invention.

FIG. 2 shows a perspective view of a first embodiment according to the present invention. Referring to FIG. 2, in the instant embodiment, the stairwell lift 1 comprises two supporting columns 11, a passenger space 12, two sliding portions 13, and a driving mechanism 14. The supporting columns 11 can be round steel columns or angle steel columns and each supporting column 11 has a column top portion 111 and a column bottom portion 112 so that a vertical or slop rail is formed between the column top portion 111 and the column bottom portion 112 for the passenger space 12. The passenger space 12 is arranged between the two vertical columns 11. The passenger space 12 comprises a seat section 121 and a foot board 122, wherein the foot board 122 is connected to the main body 121. The sliding portions 13 are respectively mounted to two opposite sides of the seat section 121 and are respectively fit over the supporting columns 11. The sliding portions 13 may comprise rolling bearings or rigid rollers (not shown) mounted therein to reduce friction coefficient and prevent shaking of the passenger space 12. The driving mechanism 14 is mounted on the column top portions 111 of the supporting columns 11 and are connected, respectively via at least two guide cables 141, to the two sliding portions 13 to drive the passenger space 12 to move along the two supporting columns 11 for ascending up to the upstairs 101 or descending down to the downstairs 102.

Specifically, the passenger space 12 involves a structure design that matches the configuration of the first to third steps of an entrance of the downstairs 102 in the stairwell 100 and the seat section 121 has a height that correspond to the height of the multiple steps or other related space of the stairwell 100 so that when the passenger space 12 descends to the downstairs 102, the seat section 121 and the foot board 122 are allowed to respectively rest on the surfaces of the steps of the stairwell 100 or rest on other related space. The seat section 121 and the foot board 122 of the passenger space 12 have a width that is substantially identical to the width of the stairway so that the passenger can easily get into and out of the passenger carrier 12 and is provided with a large and comfortable riding space. The driving mechanism 14 may comprise a winch and a winch base. The winch base is securely fixed to the column top portions 111 of the supporting columns 11 and the winch is mounted on the base. The guide cables 141 can be steel cables or chains. When the passenger activates the stairwell lift 1, the winch of the driving mechanism 14 winds or unwinds the steel cables or the chains to drive the passenger space 12 to ascend or descend.

Figure 3:
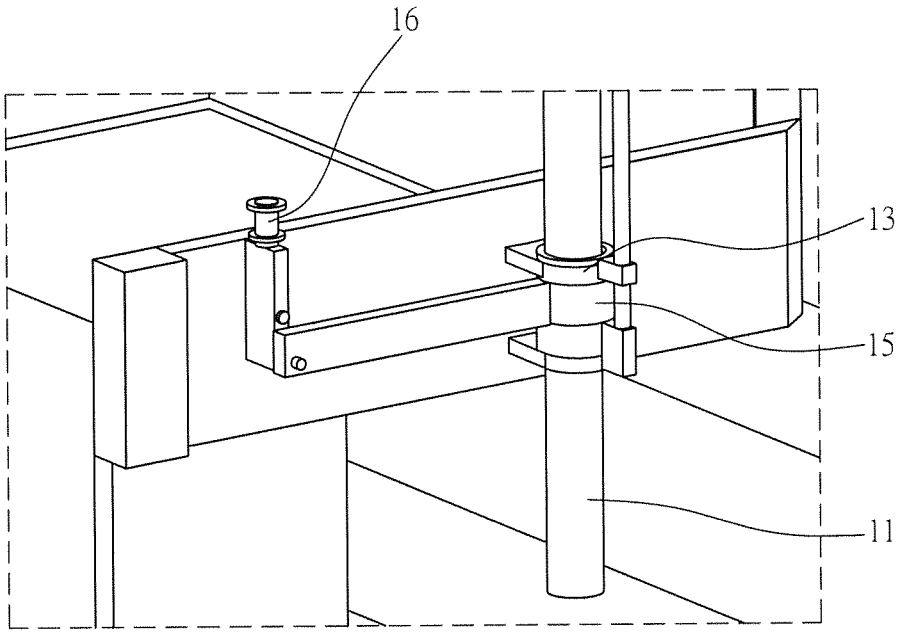
FIG. 3 is a schematic view showing an arrangement of an arrester of the first embodiment of the present invention.

FIG. 3 is a schematic view showing an arrangement of an arrester according to the present invention. With reference to both FIGS. 2 and 3, to improve the safety of the stairwell lift, in the instant embodiment, the stairwell lift 1 may selectively and additionally provided with at least two arresters 15 and at least one safety actuator 16. The arresters 15 are respectively provided on the sliding portions 13. The arresters comprise braking materials that can be brake linings or rubber that have a high friction coefficient. The safety actuator 16 is mounted to the seat section 121 and is set in operative coupling with the arresters 15. The safety actuator 16 selectively controls the arresters 15 to tightly grips on the supporting columns 11 to arrest the upward movement or downward movement of the passenger space 12. When the stairwell lift 1 is moving upward or downward fast, the passenger may pushes the safety actuator 16 to actuate the arresters 15 for gripping the supporting column 11 for slow down or stop the movement of the passenger space 12 thereby making the passenger space 12 safely reach the upstairs or the downstairs. It is noted that the seat section 121 may be additionally provided with a safety belt and a safety switch (not shown), so that after the passenger buckles up the safety belt and releases the safety switch, the passenger may then be allowed to activate the passenger carrier 12 to move upward or downward in the stairwell so that safety and protection of the passenger can be achieved.

Figure 4:
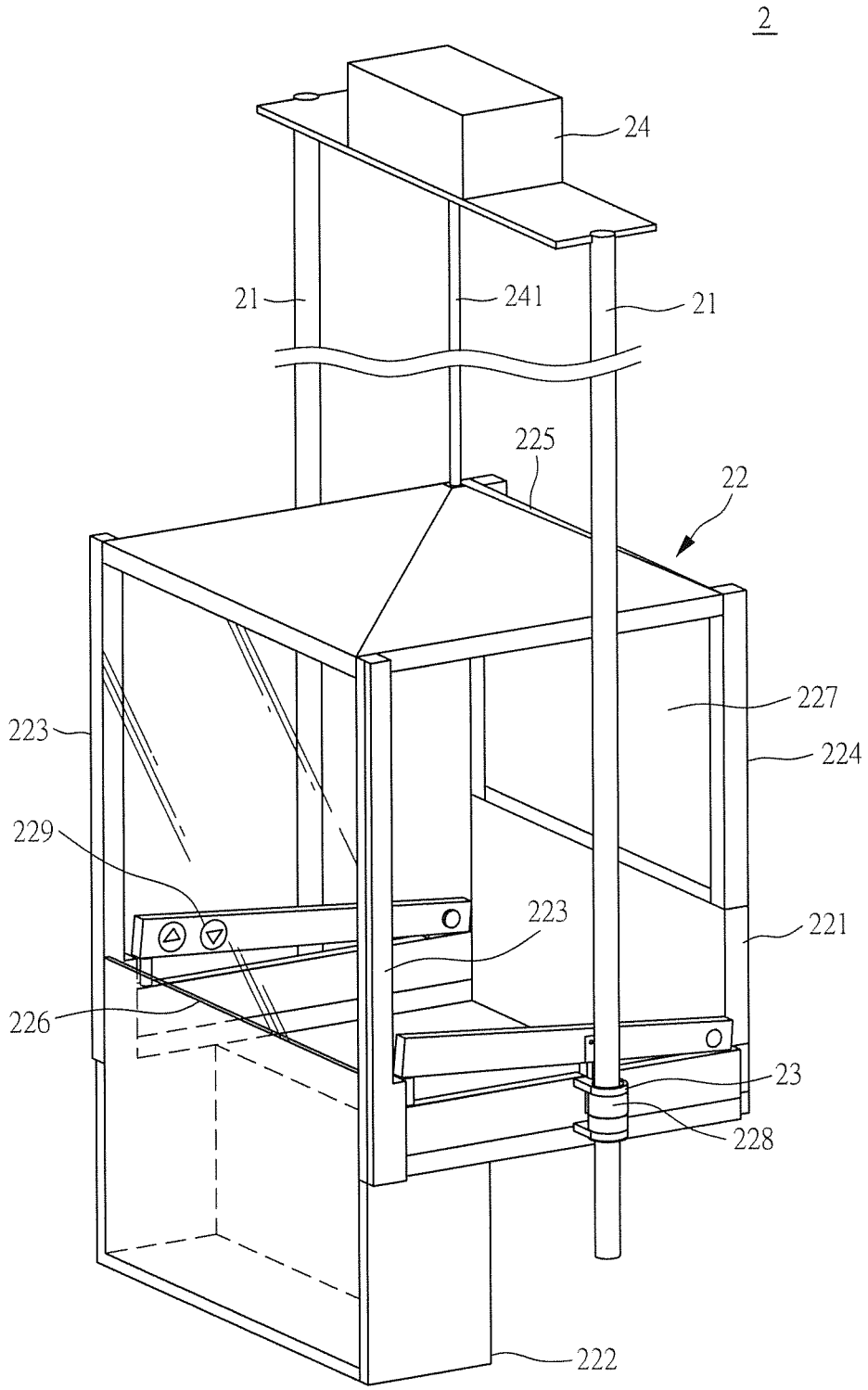
FIG. 4 is a perspective view illustrating a second embodiment in accordance with the present invention.
Figure 5:
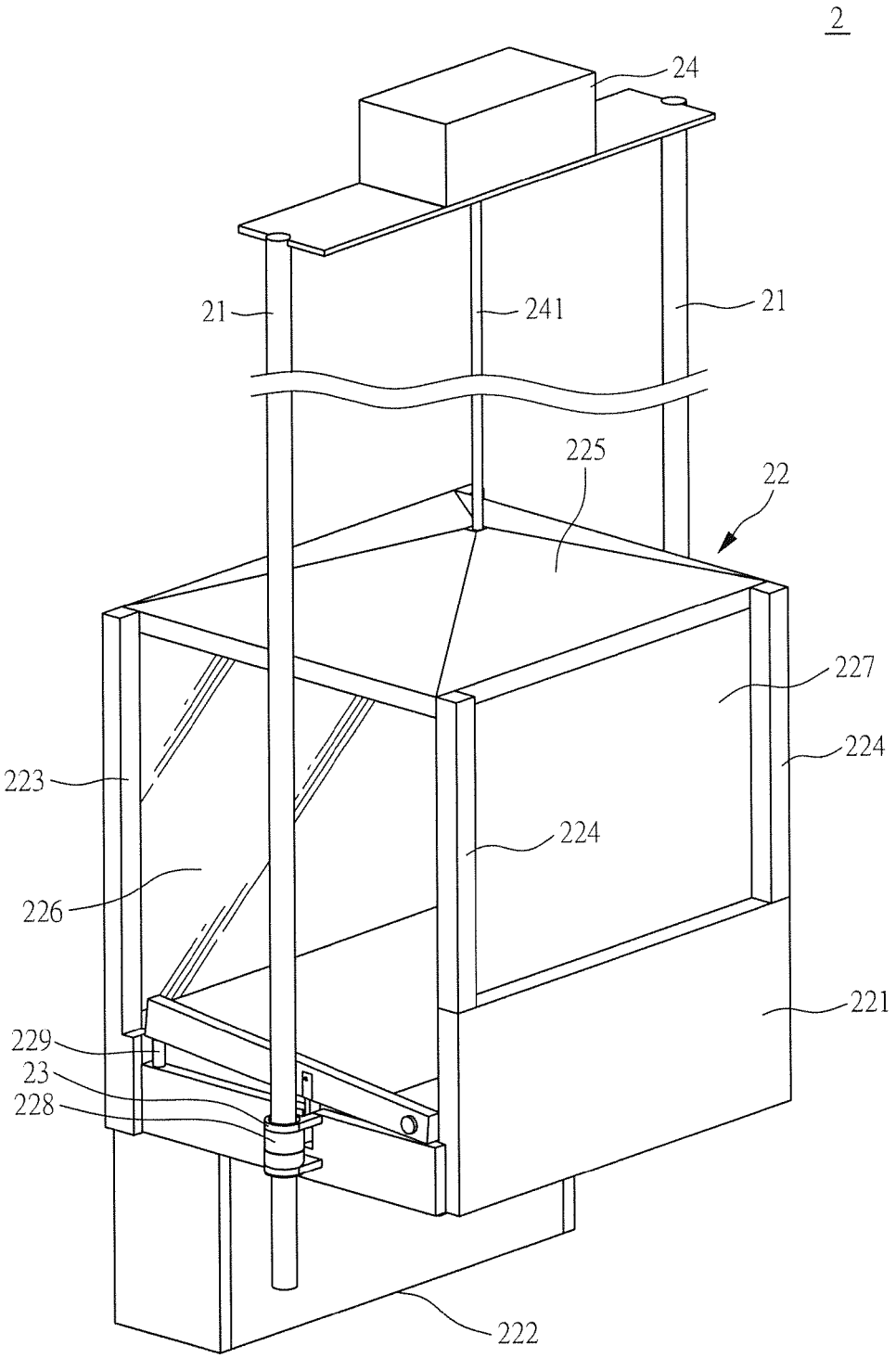
FIG. 5 is a perspective view illustrating the second embodiment of the present invention.

FIGS. 4 and 5 are perspective views illustrating a second embodiment in accordance with the present invention. Referring to FIGS. 4 and 5, in the instant embodiment, the stairwell lift 2 comprises two supporting columns 21, a passenger space 22, two sliding portions 23, and a driving mechanism 24. In the instant embodiment, in addition to a seat section 221 and a foot board 222, the passenger space 22 further comprises two front posts 223, two rear posts 224, a top board 225, a door panel 226, a back board 227, at least two arresters 228, and a control module 229. The front posts 223 and the rear posts 224 are respectively set in a circumference of the seat section 221. The top board 225 is mounted atop the front posts 223 and the rear posts 224. The driving mechanism 24 is connected, via at least one guide cable 241, to the top board 225 for driving the passenger space 22 to move along the supporting column 21 to ascend to the upstairs or descend to the downstairs (not shown). The door panel 226 is mounted to the front posts 223 and the foot board 222 in an openable and closable manner. The door panel 226 has an upper portion that forms a transparent window made of a safety material. The back board 227 is mounted to the rear posts 224 and the seat section 221. The two arresters 228 are respectively mounted to the sliding portions 23. The control module 229 is in operative coupling with the driving mechanism 24 and the arresters 228 and comprises an ascending button, a descending button and the safety actuator for controlling and arresting the upward and downward movement of the passenger space 22.

In the instant embodiment, the front posts 223, the two rear posts 224, the top board 225, the door panel 226, and the back board 227 make the passenger space 22 a passenger car for further improving the safety of the stairwell lift 2. The stairwell lift 2 may be further provided with a safety switch between the door panel 226 and the front posts 223 so that only when the door panel 226 is closed on the front posts 223, the passenger is allowed to operate the control module 229 to control the passenger carrier 22 to ascend and descend in the stairwell. When a passenger enters the passenger space 22 and closes the door panel 26, the ascending button or the descending button of the control module 229 can be pushed down to control the passenger space 22 to move upward or downward. When the passenger space 22 is moving upward or downward excessively fast, the passenger may operate an armrest type safety actuator of the control module 229 to slow down or stop the movement of the passenger space 22, making the passenger space 22 safely reach the upstairs or the downstairs. It is apparent that in addition to the control module 229 arranged in the passenger carrier 22 for controlling the stairwell lift 2, the entrances at the upstairs and the downstairs may also be provided with pushbuttons to allow a passenger to call the stairwell lift 2 to the specific site.

To prevent the stairwell lift 2 from undesirably occupying the downstairs entrance of the stairway, which may interfere with passage of people, when the stairwell lift 2 has been in a standby condition for a predetermined period of time, such as staying at the downstairs for 30 seconds or more without any passenger getting in to take the lift, a built-in program of the control module 229 activate control of the passenger space 22 for automatically ascending the upstairs (not shown) by an automatic space sensor, so as to maintain clear of a passage space of the stairway.

It is noted here that in each of the above-described embodiments, the arrangements and quantities of the supporting columns, the sliding portions, and the driving mechanism can be modified or adjusted according to the configuration of the stairwell. For example, in the second embodiment, the guide cables 241 of the driving mechanism 24 is connected to the top board 225 of the passenger space 22; however, in other embodiments, it is possible to adopt the arrangement of the first embodiment in such a way that the driving mechanism 14 comprises at least two guide cables 141 that are respectively connected to the sliding portions to move, in a way similar to the second embodiment, the passenger space 22 up or down. The present invention is not limited to what described above.

In summary, in the present invention, the passenger space is arranged to correspond to the configuration and size of the stairway and the sliding portions mounted to the two sides of the passenger space are respectively fit over the supporting columns so that the stairwell lift of the present invention provides a wide and comfortable riding space and also effectively protect the safety of the passengers. In addition, the stairwell lift of the present invention is not only arranged to connect between the upstairs and the downstairs but also arranged in other space. In details, the passenger space of the stairwell lift fits stairwell or nearby space such that the stairwell lift can apply on varied passageways.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A stairwell lift, which is installed in a stairwell connecting upstairs and downstairs or nearby the stairwell connecting upstairs and downstairs by a predetermined distance, comprising:

at least two supporting columns, each of the supporting columns having a column top portion and a column bottom portion, the column bottom portions being securely fixed to a space inside or nearby the stairwell to be spaced from each other;

a passenger space, which is arranged between the supporting columns;

at least two sliding portions, the sliding portions being respectively mounted to two sides of the passenger space and being respectively fit over the supporting columns; and at least one driving mechanism, which is mounted to the column top portions to drive the passenger space to move along the supporting columns for ascending to the upstairs or descending to the downstairs;

wherein the at least two supporting columns are arranged to be partly curve according to a location of a ceiling or sidewalls of the upstairs.

2. The stairwell lift as claimed in claim 1, wherein the passenger space comprises a seat section and a foot board, the sliding portions being respectively mounted to two sides of the seat section.

3. The stairwell lift as claimed in claim 2, wherein the seat section has a height corresponding to total height of multiple steps so that when the passenger space descend to the downstairs, the seat section and the foot board are respectively resting on surfaces of the steps of the stairwell.

4. The stairwell lift as claimed in claim 2, wherein the passenger space further comprises:

two front posts and two rear posts, which are set in a circumference of the seat section;

a top board, which is mounted atop the front posts and the rear posts, the driving mechanism comprising at least one guide cables connected to the top board to drive the passenger space to move along the supporting columns for ascending to the upstairs or descending to the downstairs;

a door panel, which is mounted to the front posts and the foot board in an openable and closable manner;

a back board, which is mounted to the rear posts and the seat section;

at least two arresters, which are respectively mounted to the sliding portions; and a control module, which is in operative coupling with the driving mechanism and the arresters to control and arrest upward and downward movement of the passenger space.

5. The stairwell lift as claimed in claim 1, wherein the driving mechanism comprises at least two guide cables respectively connected to the sliding portions to drive the passenger space to move along the supporting columns for ascending to the upstairs or descending to the downstairs.

6. The stairwell lift as claimed in claim 1 further comprising:

at least two arresters, which are respectively mounted to the sliding portions; and at least a safety actuator, which is mounted to the seat section and is in operative coupling with the arresters to control the arresters to tightly grip the supporting columns to control upward and downward movement of the passenger space.

7. The stairwell lift as claimed in claim 1, wherein after the passenger space has been staying in the downstairs for a predetermined period of time, the driving mechanism automatically drives the passenger space to ascend to the upstairs.

* * * * *